US006993805B2

(12) United States Patent
Prodoehl et al.

(10) Patent No.: US 6,993,805 B2
(45) Date of Patent: Feb. 7, 2006

(54) MULTILAYER SCRUB PAD

(75) Inventors: Michael Scott Prodoehl, Blue Ash, OH (US); Brian David Douglas, Madison, WI (US); Jennifer Lynne Brown, Wilmington, OH (US); Ronald Joseph Zink, Cincinnati, OH (US); Lisa Craft Blanton, Lebanon, OH (US); Ward William Ostendorf, West Chester, OH (US); Michael Bernard Dugas, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 452 days.

(21) Appl. No.: 10/162,441

(22) Filed: Jun. 4, 2002

(65) Prior Publication Data

US 2003/0028985 A1 Feb. 13, 2003

Related U.S. Application Data

(60) Provisional application No. 60/308,705, filed on Jul. 30, 2001.

(51) Int. Cl.
*A47L 13/12* (2006.01)
*A47L 13/16* (2006.01)

(52) U.S. Cl. ..... 15/118; 15/209.1; 15/229.11

(58) Field of Classification Search ..... 15/118, 15/208, 209.1, 244.3, 229.11
See application file for complete search history.

(56) References Cited

U.S. PATENT DOCUMENTS

| | | | |
|---|---|---|---|
| 3,629,896 | A | 12/1971 | Sirnec |
| 3,634,901 | A | 1/1972 | Landsberg |
| 3,761,991 | A | 10/1973 | Moss |
| 3,772,728 | A | 11/1973 | Johnson |
| 3,908,218 | A | 9/1975 | Oishi |
| 4,052,238 | A | 10/1977 | Botvin |
| 4,130,683 | A | 12/1978 | Michel et al. |
| 4,254,530 | A | 3/1981 | Lambert |
| 4,287,633 | A | 9/1981 | Gropper |
| 4,546,515 | A | 10/1985 | Clayton |
| 4,581,287 | A | 4/1986 | Smith et al. |
| 4,651,505 | A | 3/1987 | Gropper |

(Continued)

FOREIGN PATENT DOCUMENTS

DE 29809476 U1 10/1998

(Continued)

OTHER PUBLICATIONS

Ivan Pivko, Air Laids & All That Jazz, Notabene Associates, Inc., Longboat Key, Florida, Nonwovens Industry, Oct. 2000.

(Continued)

*Primary Examiner*—Randall Chin
(74) *Attorney, Agent, or Firm*—Stephen T. Murphy; David M. Weirich; Ken K. Patel

(57) ABSTRACT

This invention relates to a scrub pad comprising a scrubbing layer having a periphery along the edges of the layer; a wiping layer having a periphery along the edges of the layer; and an absorbent core layer having a periphery along the edges of the layer comprising at least one absorbent material selected from the group consisting of short-fiber, air-laid nonwoven material, nonwoven plastic batting, cellulosic fibrous web materials, wax coated paper, corrugated paper, fluff pulp, cotton balls, cotton batting, or mixture thereof; wherein the absorbent core layer is located intermediate to the scrubbing layer and the wiping layer and wherein the scrubbing layer, the absorbent core layer and the wiping layer are joined at the periphery of each layer.

2 Claims, 3 Drawing Sheets

U.S. PATENT DOCUMENTS

| | | | | | |
|---|---|---|---|---|---|
| 4,665,580 | A | | 5/1987 | Morris | |
| 4,674,237 | A | | 6/1987 | Sullivan | |
| 4,780,361 | A | | 10/1988 | Schlein | |
| 4,784,892 | A | * | 11/1988 | Storey et al. | 428/172 |
| 4,823,427 | A | * | 4/1989 | Gibbs et al. | 15/247 |
| 4,888,229 | A | * | 12/1989 | Paley et al. | 428/192 |
| 4,893,371 | A | | 1/1990 | Hartmann | |
| 4,949,417 | A | | 8/1990 | Wertz et al. | |
| 4,993,099 | A | | 2/1991 | Emura et al. | |
| 5,090,832 | A | | 2/1992 | Rivera et al. | |
| 5,140,785 | A | | 8/1992 | Eleouet | |
| 5,149,576 | A | * | 9/1992 | Potts et al. | 428/198 |
| 5,187,830 | A | | 2/1993 | Giallourakis | |
| 5,408,718 | A | | 4/1995 | Sadovsky | |
| 5,441,333 | A | | 8/1995 | Kim | |
| 5,671,498 | A | | 9/1997 | Martin et al. | |
| 5,681,300 | A | | 10/1997 | Ahr et al. | |
| 5,814,388 | A | | 9/1998 | Fryan | |
| D406,681 | S | | 3/1999 | Kelly et al. | |
| 6,183,587 | B1 | | 2/2001 | McFall et al. | |
| 6,645,604 | B1 | * | 11/2003 | Fereshtehkhou et al. | 428/172 |
| 6,766,552 | B1 | * | 7/2004 | Policicchio et al. | 15/228 |
| 6,807,702 | B2 | * | 10/2004 | Keck et al. | 15/104.94 |
| 6,808,791 | B2 | * | 10/2004 | Curro et al. | 428/198 |
| 2003/0003832 | A1 | * | 1/2003 | Childs et al. | 442/381 |

FOREIGN PATENT DOCUMENTS

| | | | |
|---|---|---|---|
| DE | 20003876 | U1 | 6/2000 |
| JP | 5-91550 | U | 12/1993 |
| WO | WO 99/18838 | | 4/1999 |
| WO | WO 01/45616 | A1 | 6/2001 |

OTHER PUBLICATIONS

U.S. Appl. No. 09/914,860, filed Apr. 10, 2000, J. Richard Noel et al.

U.S. Appl. No. 09/467,938, filed Dec. 21, 1999, John J. Curro et al.

U.S. Appl. No. 09/584,676, filed May 31, 2000, John J. Curro et al.

U.S. Appl. No. 10/149,878, filed Dec. 20, 2000, John J. Curro et al.

U.S. Appl. No. 09/886,828, filed Jun. 21, 2001, John J. Curro.

U.S. Appl. No. 09/886,740, filed Jun. 21, 2001, John J. Curro.

U.S. Appl. No. 09/994,532, filed Nov. 27, 2001, Vy K. Hyuhn, et al.

* cited by examiner

MULTILAYER SCRUB PAD

CROSS REFERENCE TO RELATED APPLICATIONS

This application claims the benefit of U.S. Provisional Application No. 60/308,705 filed Jul. 30, 2001.

TECHNICAL FIELD

This invention relates to a multilayer scrub pad which provides both safe, aggressive scrubbing and dry wipe-up capabilities. The scrub pad has three layers, a scrubbing layer, an absorbent core layer, and a wiping layer.

BACKGROUND OF THE INVENTION

Cleanliness has long been recognized as a condition which makes a person's living conditions more desirable. Cleanliness is particularly desired in the kitchen and other areas of food preparation, where it is well known that bacteria and other disease causing organisms may readily grow on residual organic matter on counter-tops, sinks, cooking utensils and the like. Historically, people used rags and cloths as cleaning devices for cleaning slightly soiled surfaces and abrasive materials, such as steel wool pads for more severely soiled surfaces.

Many developments have been made to improve the scrubbing performance of these basic cleaning implements. These developments have included the incorporation of a lacquer on a cloth which when broken up provided an abrasive rubbing surface. (U.S. Pat. No. 1,961,911) and the attachment of an abrasive structure on a cloth or pad. (U.S. Pat. Nos. 2,778,044, 2,910,710, and 3,169,264)

More recently, with the development of specialized surfaces, especially non-stick surfaces such as Teflon®, and Silverstone®, and high gloss kitchen surfaces such as stainless steel and gloss enamels, developments have been made to produce aggressive cleaning on these surfaces without abrasion and scratching of steel wool pads.

It is also known that it is desirable to have scrubbing devices which carry more water to the target surface to be cleaned. Sponges are a classic example of cleaning devices which carry water to a surface. There have also been products which deliver water to a target surface by use of closed- or open-celled foams. Of course, sponges and foams have been marketed with and without abrasive structures attached to them. (U.S. Pat. Nos. 2,906,643 and 5,671,498)

One problem with typical cloth, sponge or foam containing products is that the is residual water and food or dirt retained in the device after use provides a breeding area for germs and bacteria which contaminate the cleaning device itself. Consumers are reluctant to use sponges/foam products for longer than a few days, and yet are also reluctant to throw them away due to the relatively high cost of the implement.

There is a need for a scrubbing device which has a low enough cost to be considered disposable and yet still provides the gentle cleaning of a sponge or rag and the non-abrasive, aggressive cleaning of a meshed product.

SUMMARY OF THE INVENTION

This invention relates to a scrub pad comprising:

a) a scrubbing layer having a periphery along the edges of the layer;

b) a wiping layer having a periphery along the edges of the layer; and c) an absorbent core layer having a periphery along the edges of the layer comprising at least one absorbent material selected from the group consisting of short-fiber, air-laid nonwoven material, nonwoven plastic batting, cellulosic fibrous web materials, wax coated paper, corrugated paper, fluff pulp, cotton balls, cotton batting, or mixture thereof;

wherein the absorbent core layer is located intermediate to the scrubbing layer and the wiping layer and wherein the scrubbing layer, the absorbent core layer and the wiping layer are joined at the periphery of each layer.

BRIEF DESCRIPTION OF THE DRAWINGS

While the specification concludes with claims pointing out and distinctly claiming the present invention, it is believed the same will be better understood by the following drawings taken in conjunction with the accompanying specification wherein like components are given the same reference number.

DETAILED DESCRIPTION OF THE INVENTION

Scrub Pad

The present invention provides a disposable scrub pad that makes cleaning easier, particularly kitchen cleaning such as counter tops, stove tops, and non-stick cookware. The scrub pad can scrub surfaces, wipe up surfaces, absorb water, and be easily controlled in use. The scrub pad is flexible and thin enough to perform a variety of cleaning tasks more conveniently than traditional sponges and pad. Scrubbing efficacy is comparable to that of medium duty, durable implements, such as Scotchbrite All-Purpose® pad, while still being non-scratching on surfaces, including non-stick surfaces such as Teflon®. The scrub pad provides this level of efficacy and yet is still disposable. Its disposable nature eliminates the hygiene negatives such as unpleasant smell and bacterial growth commonly associated with durable cleaning implements.

Figure 1:
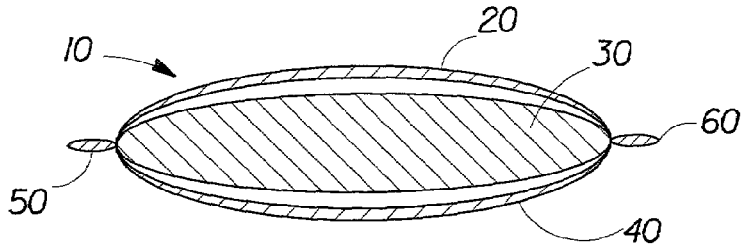
FIG. 1 is a cross-sectional view of the multilayered scrub pad of the present invention.
Figure 2:
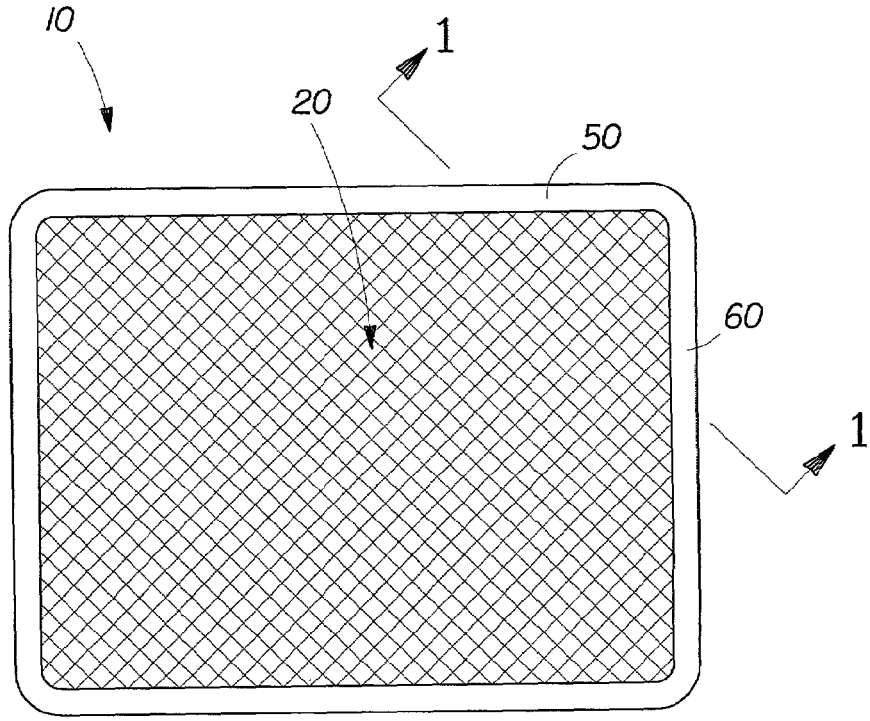
FIG. 2 is a top plan view of the multilayered scrub pad of the present invention.

Referring to FIGS. 1 and 2, the scrub pad 10 of the present invention comprises three layers, a scrubbing layer 20, an absorbent core layer 30 and a wiping layer 40. Each of the layers have a periphery 50 along the outer edges of the material circumscribing the piece of material comprising the layer. The layers are combined into a single implement by any standard adhesion method, including thermal bonding, adhesive bonding, and pressure/adhesive bonding, stitching to create a bonded edge 60 along the periphery 50 of the scrub pad.

Scrubbing Layer

The scrubbing layer 20 of the scrub pad provides aggressive scrubbing power to abrade foreign material off surfaces while still being safe from scratching surfaces. The scrubbing layer comprise any material which has ridges and valleys that abrade foreign material off a surface to be cleaned and is flexible to clean textured and contoured surfaces. Preferably the material comprising the scrubbing layer 20 doesn't deform under pressure and has a hardness lower than the hardness of most surfaces thereby minimizing scratching. The scrubbing layer 20 comprises at least one ply of such materials, preferably having 1, 2, 3 or 4 plies, more preferably having 1 or 2 plies, and most preferably having 2 plies.

The materials of the scrubbing layer 20 may be any plastic material. Preferably, the materials of the scrubbing layer 20 are selected from the group consisting of polyethylene, polypropylene, nylon, mixtures thereof. The material can be of any form which provides the ridges and valley described above. This includes, but is not limited to meshes or scrims of filaments, woven substrates, ribbons, ribbons interwoven with filaments, slitted films, or airblown or through-air dried substrates. Preferably the material is in the form of a mesh or scrim of filaments, ribbons, or ribbons interwoven with filaments. Most preferably the material is in the form of a mesh of filaments.

Figure 5A:
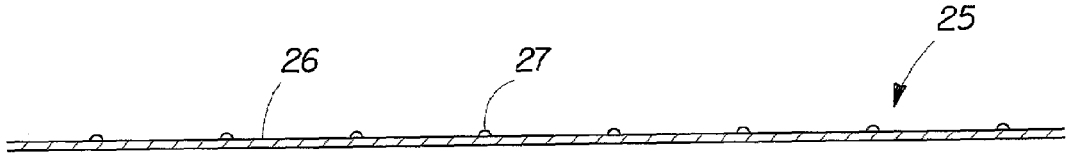
FIG. 5(*a*) and FIG. 5(*b*) are a cross-sectional views of different plies mesh which may be used in the scrubbing layer of the present.
Figure 5B:
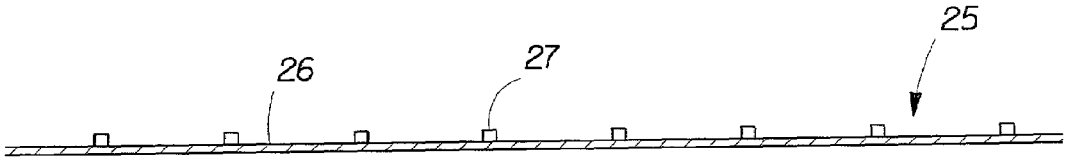

Referring to FIGS. 5(*a*) and 5(*b*), the preferred mesh or scrim plies 25 of scrubbing layer 20 are optimized to provide high dirt removal and yet still allow the scrubbing layer 20 to be rinsed of dirt after use. The mesh or scrim plies 25 generally comprise filaments 26 having a diameter ranging from about 0.10 mm to about 1.0 mm, preferably from about 0.15 mm to about 0.75 mm, and more preferably from about 0.2 mm to about 0.5 mm. The filaments have a total tensile strength ranging from about 2000 grams per inch (g/in) to about 30,000 g/in, preferably from about 4000 g/in to about 20,000 g/in.

The mesh or scrim plies 25 have a basis weight ranging from about 7 grams per square meter (gsm) to about 120 gsm, preferably from about 20 gsm to about 100 gsm. Even more preferably the scrubbing layer comprises a first mesh ply 21 having a basis weight ranging from about 20 gsm to about 50 gsm, preferably from about 25 gsm to is about 40 gsm, and a second mesh ply 22 having a basis weight ranging from about 30 gsm to about 120 gsm, preferably from about 50 gsm to about 100 gsm, more preferably from about 70 gsm to about 90 gsm.

The filaments 26 of the mesh form cells 28 bounded by the filaments. The cells 28 may be any shape. Preferably the cells 28 are the shape of a square, diamond, hexagon, or rectangle and more preferably they are in the form of a square. Another preferred embodiment comprises two mesh plies, each ply having a different cell shape 28. Each cell 28 bordered by the filaments 26 has an defined area. The area, or cell size, may range from about 2 $mm^2$ to about 25 $mm^2$, preferably from about 8 $mm^2$ to about 16 $mm^2$, and more preferably from about 10 $mm^2$ to about 13 $mm^2$.

Where the filaments 26 of the mesh intersect, a node 27 is formed by sealing the filaments together. The node 27 is generally disposed on one face of the mesh ply resulting in a ply 25 which is smoother to the touch on one side and rougher to the touch on the side with the nodes. It is preferred that when mesh plies are used that the face having the nodes is disposed outward from the scrub pad 10, thereby providing more aggressive scrubbing. The node 27 at this intersection may be square or rounded shape, preferably square, and will have a node size ranging from about 0.2 mm to about 1.0 mm, preferably from about 0.25 mm to about 0.9 mm and more preferably from about 0.5 mm to about 0.75 mm.

Preferred mesh plies for use in the scrubbing layer of the scrub pad of the present invention include but are not limited to the following.

TABLE 1

Typical Mesh Ply Materials

| | Material | Cell Shape | Basis Weight (gsm) | Total Tensile (g/in) | Cell Size ($mm^2$) | Filament Diameter (mm) |
|---|---|---|---|---|---|---|
| RO6277[1] | Polypropylene | Square | 7 | 4500 | 16 | 0.17 |
| 800287-005[1] | Polypropylene | Square | 25 | 10000 | 9 | |
| RO6200[1] | Polypropylene | Square | 32 | 17000 | 12 | 0.25 |
| RO7107[1] | Polypropylene | Square | 46 | 19000 | 20 | 0.37 |
| WO3927[1] | Polypropylene | Square | 123 | 11000 | 10 | |
| 800287-102[1] | Polypropylene | Square | 100 | 9000 | 10 | 0.40 |
| MN-66-4.75[2] | Polypropylene | Diamond | 33 | 4500 | 12 | 0.20 |

Figure 3:
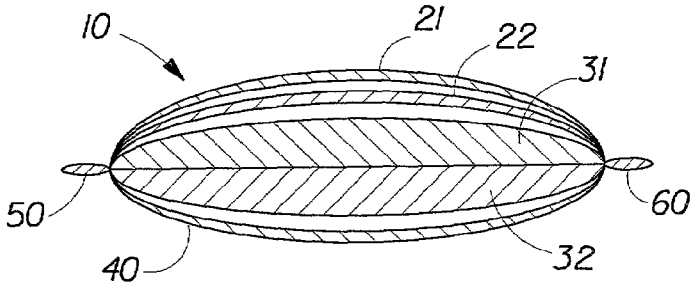
FIG. 3 is a cross-sectional view of one embodiment of the multilayered scrub pad of the present invention.
Figure 4:
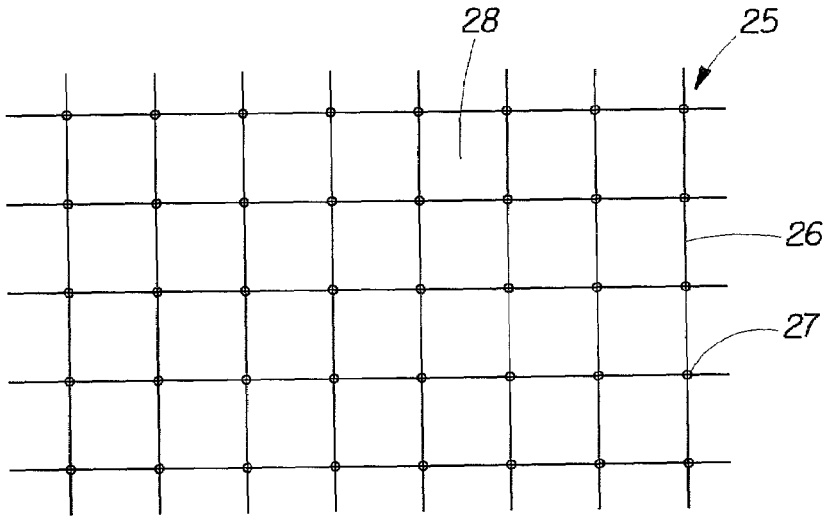
FIG. 4 is a top plan view of a ply of mesh which may be used in the scrubbing layer of the present invention.

[1]Mesh from Conwed Plastics, Minneapolis, MN
[2]Mesh from Masternet Ltd., Mississauga, Ontario, Canada In a preferred embodiment, FIG. 3 the scrubbing layer 20 comprises two mesh plies. The outer ply 21, positioned on the outside of the scrub pad 10, consists of a 32 gsm basis weight polypropylene mesh, having filaments 26 of 0.25 mm diameter, which form square cells 28 having a cell size of 12 $mm^2$ and form round 0.5 mm nodes 27. This material may be purchased as RO6200 mesh from Conwed Plastics, Minneapolis, Minn. The inner ply 22, positioned between the outer ply 21 and the absorbent core layer 30, consists of a 100 gsm basis weight polypropylene mesh having filaments 26 of 0.40 mm diameter, which form round cells 28 having a cell size of 10 $mm^2$ and form round 0.75 mm nodes 27.

Absorbent Core Layer

The absorbent core layer 30 is a thin and flexible layer of absorbent material which is used to transport fluid to or from either the scrubbing side 20 or the wiping side 40 of the pad 10 as needed while cleaning a surface.

The absorbent core layer 30 may be manufactured in a wide variety of sizes and shapes (e.g., rectangular, oval, hourglass, dog bone, asymmetric, etc.). The configuration and construction of the absorbent core may also be varied (e.g., the absorbent core may have varying caliper zones (e.g., profiled so as to be thicker in the center), or may comprise one or more layers or structures. The total absorbent capacity of the absorbent core should, however, be compatible with the design loading and the intended use of the scrub pad. Further, the size and absorbent capacity of the absorbent core may be varied. The absorbent core layer has a total basis weight ranging from about 100 gsm to about 2000 gsm, preferably from about 200 gsm to about 750 gsm, and more preferrably from about 400 gsm to about 600 gsm. The absorbent core layer has a dry thickness caliper ranging from about 100 mils to about 1000 mils, preferably from about 200 mils to about 800 mils, and more preferably from about 300 mils to about 600 mils. In preferred embodiments comprising more than one ply of absorbent material the basis weight of each ply ranges from about 100 gsm to about 500 gsm, preferably from about 200 to about 400 gsm and the dry caliper thickness ranges from about 50 mils to about 500 mils, preferably from about 100 mils to about 300 mils.

The absorbent core layer 30 may incorporate one or more plies of absorbent materials. Absorbent materials may include any suitable absorbent material known in the art including, but not limited to, short-fiber airlaid nonwoven materials; nonwoven plastic batting of materials such as polyethylene, polypropylene, nylon, polyester, and the like; cellulosic fibrous materials such as paper tissue or towels known in the art, wax-coated papers, corrugated paper materials, and the like; fluff pulp, cotton balls, cotton batting. The absorbent core layer 30 preferably comprises from 1 to 15, preferably from 1 to 4 layers of absorbent material selected from the group consisting of short-fiber airlaid nonwoven material, nonwoven plastic batting, cellulosic fibrous materials, and mixtures thereof as long as the combined total basis weight and dry caliper meet the requirements described above. The phrase "from 1 to 15" and "from 1 to 4" are understood to include the stated numbers and all the integers between them. For example, from 1 to 4 means 1, 2, 3, and 4.

The absorbent core layer 30 may comprise one or more absorbent cellulosic fibrous webs. A cellulosic fibrous web is a fibrous, macroscopically two-dimensional and planar, although not necessarily flat. Such a web does have some thickness in the third dimension. However, this thickness is very small compared to the actual first two dimensions. Within the fibrous structure may be at least two regions distinguished by an intensive property such as basis weight, density, projected average pore size or thickness. Such a web is disclosed in U.S. Pat. No. 5,277,761, issued Jan. 11, 1994 to Van Phan et al and incorporated herein by reference.

The two-dimensional cellulosic webs are composed of fibers, which are approximated by linear elements. The fibers are components of the two-dimensional fibrous web, which components have one very large dimension (along the longitudinal axis of the fiber) compared to the other two relatively very small dimensions (mutually perpendicular, and both radial and perpendicular to the longitudinal axis of the fiber), so that linearity is approximated. While, microscopic examination of the fibers may reveal two other dimensions, which are small, compared to the principal dimension of the fibers, such other two small dimensions need not be substantially equivalent or constant throughout the axial length of the fiber. It is only important that the fiber be able to bend about its axis and be able to bond to other fibers.

The fibers may be synthetic, such as polyolefin or polyester; are preferably cellulosic, such as cotton linters, rayon or bagasse; and more preferably are wood pulp, such as softwoods (gymnosperms or coniferous) or hardwoods (angiosperms or deciduous) or are layers of the foregoing. As used herein, a fibrous web is considered "cellulosic" if the fibrous web comprises at least about 50 weight percent or at least about 50 volume percent cellulosic fibers, including but not limited to those fibers listed above. A cellulosic mixture of wood pulp fibers comprising softwood fibers having a length of about 2.0 to about 4.5 millimeters and a diameter of about 25 to about 50 micrometers, and hardwood fibers having a length of less than about 1 millimeter and a diameter of about 12 to about 25 micrometers has been found to work well for the fibrous webs described herein.

Such a web may be comprised of a single ply or of multiple plies. The layer may be embossed or nonembossed. Such a layer can be comprised of a tissue paper such as a BOUNTY® paper towel, available from The Procter & Gamble Co., Cincinnati Ohio, USA. BOUNTY® paper towels are manufactured under the protection of U.S. Pat. Nos. 4,529,480; 4,637,859; 4,687,153; 5,223,096; and 5,240,562; said patents being hereby incorporated by reference.

The absorbent core layer 30 may also comprise short-fiber airlaid nonwoven materials, such as latex bonded airlaid (LBAL) nonwovens, thermally bonded air-laid (TBAL) nonwoven materials, multi-bonded airlaid (MBAL) nonwovens, or hydroentangled (HEAL) nonwovens. The airlaid nonwovens may comprise natural fibers such as cotton or cellulose fiber; thermoplastic fibers such as polyethylene, polypropylene, and copolymers of polyethylene or polypropylene; and/or nonthermoplastics such as polyesters.

The absorbent core layer 30 of the present invention preferably comprises an airlaid web comprising hardwood pulp fibers, softwood pulp fibers or mixtures thereof. The absorbent core may also incorporates superabsorbent material throughout the web. Additionally, the absorbent core layer may also incorporate a binder material such as bicomponent binder fibers in the uniform admixture of fibers described above.

One embodiment of the scrub pad 10 of the present invention comprises an absorbent core comprising either one or two layers of thermal bonded air-laid nonwoven material consisting of 70% softwood pulp fibers and 30% bicomponent polyethylene/polypropylene binding fibers having a basis weight of 250 gsm, and a caliper thickness of 220 mils. Another embodiment comprises multiple plies of absorbent material 31 and 32, each of which contains a substantially uniform mixture of hardwood pulp fibers, softwood pulp fibers, and a binder material (such as bicomponent binding fibers or a powdered binder) in a thermally bonded airlaid structure. A particularly preferred hardwood pulp fiber is a eucalyptus fiber. A particularly suitable eucalyptus fiber includes those of the eucalyptus grandis species. The hardwood pulp fibers, and eucalyptus in particular, have high surface area, thereby providing the absorbent web with a high capillary pressure. Too much hardwood pulp fiber, however, in the web will reduce its overall absorbent capacity. Additionally, the presence of excess hardwood pulp fiber may lower the fluid handling speed of the web to an unacceptably low level. Other suitable fibers for use as a hardwood pulp fiber in the absorbent core include acacia, oak, maple, or cherry fibers. The softwood pulp fibers are preferably blended into the web in the ratios indicated above. A particularly preferred softwood pulp fiber is southern softwood kraft fibers. Other suitable softwood fibers include western or northern softwood kraft fibers.

The absorbent core layer 30 of the present invention may also incorporate bicomponent binding fibers or a superabsorbent material. In more preferred embodiments, both the bicomponent fibers and the superabsorbent material are present in the web and are blended in a substantially uniform mixture throughout the web thickness.

The addition of bicomponent fibers allows for positive stiffness control of the overall layer. The stiffness of the web is controlled by adjusting the amount of bicomponent fiber as well as the time and temperature parameters of the thermal bonding process. In a particularly preferred embodiment, about 5% to about 50%, more preferably about 20% to about 40%, of the web is bicomponent fibers. A preferred fiber comprises a polyethylene/polypropylene fiber in which the polypropylene core is surrounded by a polyethylene sheath. Such a suitable 50%/50% concentric bicomponent fiber is available form Danaklon of Varde, Denmark.

Other binder materials may be included within the web structure as well. Polyethylene powder binders and/or latex binder material may be, but need not be, incorporated into the web structure. The use of a powder binder such as polyethylene allows the web to be a thermally bonded structure as is the case with the bicomponent binder fibers described above. If latex, or a similar binder is used, the latex will act as the binder and the structure may be described as "latex bonded."

If desired, a superabsorbent material may also be incorporated in a uniform or non-uniform manner into one or both of the fibrous web layers. Any variety of superabsorbent particulate material may be incorporated into the absorbent core of the present invention. One especially preferred material is SAB 960 available from Stockhausen Louisiana, Ltd. of Garyville, La. Other especially preferred superabsorbent materials include surface crosslinked polyacrylates such as ASAP 2300 available from Chemdal, Corp. of Palatine, IL and the mixed bed materials described in copending, commonly assigned U.S. patent application Ser. No. 09/258,890, filed in the name of Hird, et al. on Mar. 1, 1999. A superabsorbent fiber known as "FIBERDRI" available from Camelot Superabsorbents, Ltd., Calgary, Alberta, is also suitable. The superabsorbent material may take any suitable form including fibers, flakes, or small discrete particles. As used herein, the term "particles" is intended to mean any of these forms of superabsorbent material. In preferred embodiments, the superabsorbent material comprises small flakes or discrete particulate material incorporated into the web 40. Such superabsorbent material preferably comprises from about 10% to about 50% of the overall fibrous absorbent web. A higher amount of such superabsorbent material increases the overall capacity of the web layer 40. Excess superabsorbent material, however, may reduce the permeability of the web layer 40 due to gel blocking or similar effects.

The absorbent web of the present invention may be made by any suitable airlaying technique known in the art. The use of airlaying allows the incorporation of particulate superabsorbent material throughout the structure, as well as greater positive control over the web physical properties than may be possible with other web forming techniques.

When the web incorporates bicomponent fibers, the web is preferably formed using a thermally bonded airlaid technique as described above. In such a construction, the use of additional binder material such as powder binder or latex is not required. Such additional materials may, nonetheless, be included in order to form a multi-bonded airlaid web. Additionally the web need not incorporate any bicomponent fiber, and may use latex in combination with the superabsorbent particles and hardwood and softwood pulp fibers as described above to form a latex bonded airlaid structure. Suitable methods of forming such airlaid structures are well known in the art. Another alternative includes the use of a powdered binder such as polyethylene together with a multiplicity of hardwood pulp and softwood pulp fibers to form a thermally bonded airlaid web.

Wiping Layer

The wiping layer 40 may comprise any material that allows fluid to pass through it into the core and is soft to the touch. Preferably, the wiping layer comprises a material which provides improved transport to the absorbent core, thereby leaving wiped surfaces drier than typical cleaning implements. Therefore, the wiping layer may comprise any material which provides this transport and is flexible and durable enough to survive the multiple scrubbings of, for example, washing a set of pots and pans from a meal. Materials for use in the wiping layer may include cellulosic fibrous webs material, laminated thermoplastic/cellulosic webs; or hydroentangled, spunbond, carded, or apertured nonwoven materials.

Figure 6:
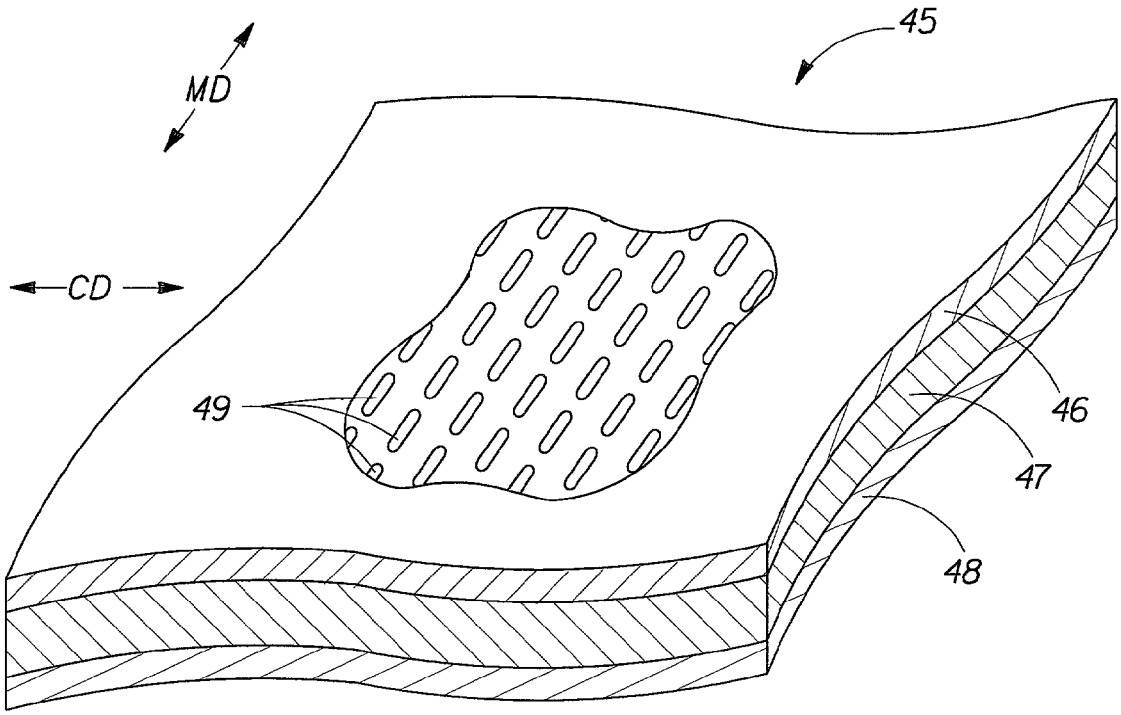
FIG. 6 is a perspective view of a laminate web which may be used in the wiping layer of the present invention.

Referring to FIG. 6, preferably the wiping layer 40 of the scrub pad 10 of the present invention comprises an apertured laminate web 45 comprising at least three layers or plies, disposed in a layered, face-to-face relationship as disclosed in U.S. patent application Ser. Nos. 09/467,938 and 09/584,676 (also WO 01/45616) both of which are herein incorporated by reference. A first outer layer 46 of the laminate web 45 is preferably thermally bondable, and is preferably a nonwoven web comprising a sufficient quantity of thermoplastic material, the web having a predetermined extensibility and elongation to break. By "sufficient quantity" is meant a quantity of thermoplastic material adequate to enable enough thermal bonding upon application of heat and/or pressure to produce a unitary web. The first outer layer has a basis weight ranging from about 10 gsm to about 75 gsm, preferably from about 15 gsm to about 40 gsm. A second outer layer 48 is preferably the same material as first outer layer 46, but may be a different material, also being thermally bondable and having a predetermined extensibility and elongation to break. The second outer layer has a basis weight ranging from about 10 gsm to about 75 gsm, preferably from about 15 gsm to about 40 gsm. The first and second outer layers 46 and 48 may each also comprise up to about 50% on nonthermoplastic material such as polyester, cellulose, staple fibers and mixtures thereof. At least one third central absorbent layer 47 is disposed between the two outer layers 46 and 48. The third central absorbent layer 47 has a total basis weight ranging from about 10 gsm to about 100 gsm, preferably from about 15 gsm to about 50, and more preferably from about 20 to about 30 gsm.

The laminate web 45 is processed by joining means, such as by ultrasonic welding, or thermal calendaring, to provide a plurality of melt bond sites that serve to couple the outer layers, and, in some embodiments, portions of central layer, thereby forming the constituent layers into a unitary web. When joined together, the two outer layers form an interior region between them. The interior region is the space between the outer layers surrounding the bond sites. In a preferred embodiment, the third central layer 47 substantially fills the interior region, the third central layer being apertured 49 coincident the bond sites.

While the laminate web 45 is disclosed primarily in the context of nonwoven webs and composites, in principle the laminate web can be made out of any web materials that meet the requirements, (e.g, melt properties, extensibility) as necessary for the scrub pad of the present invention. For example, the outer layers can be apertured thermoplastic films, micro-porous films, apertured films, and the like. Absorbent central layer can be a cellulosic fibrous web as defined above, including tissue paper; other non-thermoplastic web material, woven fabric, and the like. In general, it is required that outer layer materials be flexible enough to be processed as described herein. However, central layer 47 can be a brittle, relatively stiff material, as long at it also can be processed as described herein, albeit possibly becoming fractured, broken, or otherwise broken up in the process.

When the apertures 49 are formed, the thermally bonded portions of outer layers remain primarily on the portions of the aperture perimeters corresponding to the length dimension of bond sites. Therefore, each aperture does not have a perimeter of thermally bonded material, but only portions remain bonded. One beneficial property of such a laminate web is that once apertured, fluid communication with the central layer is facilitated. Thus, an absorbent central layer 47 can be used between two relatively non-absorbent outer layers, and the laminate becomes a wiper which transports moisture from a surface, to the absorbent core layer 30, thereby leaving a relatively dry to the touch outer surface. One example of the preferred apertured laminate web is a web having outer layers of relatively extensible nonwovens, with a central layer of relatively low extensibility tissue paper. Fluids could thus be absorbed via the apertures, the perimeter of which can be open at portions which provide fluid communication to the absorbent central core. If a relatively hydrophobic nonwoven web is used for the outer layers, such a wiping layer could exhibit dry-to-the-touch properties along with high absorbency.

Another example of the apertured laminate web to be used in the wiping layer is a web having outer layers of relatively extensible nonwovens, with a central layer of relatively low extensibility tissue paper. One particularly interesting structure incorporates a highly hydrophobic outer layer combined with a highly absorbent central layer. A suitable hydrophobic material is described in U.S. Pat. No. 3,354,022 Dettre et al. Such a material has a water repellent surface having an intrinsic advancing water contact angle of more than 90 degrees and an intrinsic receding water contact angle of at least 75 degrees. Such a material exhibits extremely hydrophobic properties, similar to the effect known to exist on leaves from the Lotus plant. When such a material is combined with an absorbent central layer, such as a BOUNTY® paper towel tissue layer, the resulting composite can be highly absorbent while retaining a very clean and dry outer surface. The basis weight and porosity of the outer layer can be varied to achieve different degrees of absorbent performance. In one embodiment the laminate could also be post-laminated to a fluid-impervious backing layer to form an absorbent fluid barrier.

Another embodiment of a laminate web of the present invention utilizing nonwoven webs as the outer layers is characterized by distinct regions differentiated by fiber orientation. Differential fiber orientation can be achieved by providing for localized regions within the web that experience greater extension than other regions. For example, by locally straining the web to a greater degree in the regions corresponding to regions regions of significant fiber reorientation are formed. Such localized straining is possible by the method of the present invention detailed below.

Additionally, more than one central layer can be used with beneficial results. For example, a structure comprising a cellulosic tissue central web and a polymeric film central web between two nonwoven webs can produce an absorptive wiping article with one side being relatively more absorptive than the other. If the film layer is a three-dimensional formed film, the film side can provide added texture to the laminate which is beneficial in many wiping applications. Macroscopically-expanded, three-dimensional formed films suitable for use in the present invention include those described in commonly-assigned U.S. Pat. No. 3,929,135 issued to Thompson on Dec. 30, 1975, and U.S. Pat. No. 4,342,314 issued to Radel et al. on Aug. 3, 1982, both patents hereby incorporated herein by reference.

Other wiping layers may also include nonwoven web materials made through known processes in the art such as air-laid, carded, spunbond, hydroentangled/spunlace, thru-air bonded and coform or other materials that transmit water such as porous formed films. Nonwoven substrates can be generally defined as bonded fibrous or filamentous products having a web structure, in which the fibers or filaments can be distributed haphazardly as in "air-laying" or certain "wet-laying" processes, or with a degree of orientation, as in certain "wet-laying" or "carding" processes. The fibers or filaments of such nonwoven substrates can be natural (e.g., wood pulp, wool, silk, jute, hemp, linen, or sisal) or synthetic (e.g., rayon, cellulose ester, polyvinyl derivatives, polyolefins, polyamides, or polyesters) and can be bonded together with a polymeric binder resin. A nonwoven wiping layer is preferably hydrophilic and has some absorbent capacity. Most preferably a nonwoven wiping layer is apertured. Examples of suitable commercially available spunlace substrates include grades 140–130 and 140–146 by BBA Nonowovens and grade PGI-5918 by Polymeric Group, Inc.

Preferred apertured laminate webs for use in the wiping layer of the scrub pad of the present invention include webs having:

First and second outer layers comprising 20 gsm basis weight low density polypropylene carded nonwoven material and a third absorbent inner layer comprising a 24 gsm basis weight Bounty® paper towel;

First and second outer layers comprising 30 gsm basis weight low density polyethylene spunbond nonwoven material and a third absorbent inner layer comprising a 42 gsm basis weight Bounty® paper towel;

First and second outer layers comprising 30 gsm basis weight low density polypropylene spunbond nonwoven material and a third absorbent inner layer comprising a 42 gsm basis weight Bounty® paper towel;

First and second outer layers comprising 30 gsm basis weight low density polyethylene spunbond nonwoven material and a third absorbent inner layer comprising two layers of 42 gsm basis weight Bounty® paper towel;

First outer layer comprising a 30 gsm basis weight 80/20 blend of polyethylene and polypropylene spunbond nonwoven material; a second outer layer of a 30 gsm basis weight 50/50 blend of polyethylene and polypropylene spunbond nonwoven material; and a third absorbent inner layer consisting of a 42 gsm basis weight Bounty® paper towel and a 23 gsm basis weight polyethylene film;

First and second outer layers comprising a 30 gsm basis weight low density polyethylene spunbond nonwoven material and a third absorbent inner layer consisting of a 42 gsm basis weight Bounty® paper towel and an 88 gsm basis weight elastomeric formed film; and First outer layer comprising a 27 gsm basis weight high elongation carded polypropylene nonwoven material; a second outer layer of a 60 gsm basis weight 50/50 blend of polyethylene and polypropylene spunbond nonwoven material; and a third absorbent inner layer consisting of a 42 gsm basis weight Bounty® paper towel.

Optional Ingredients

The scrub pad of the present invention is contemplated such that typical cleaning compositions such as surfactants and antimicrobial agents can be added to any of the layers of the pad.

Methods of Making

The multilayered scrub pad of the present invention may be produced using any of the typical fastening or bonding methods in the art. These include, but are not limited to mechanical fastening such as stitching, stapling, riveting, etc.; thermal bonding, ultrasonic bonding, high pressure bonding, adhesive bonding, and combinations thereof such as adhesive/thermal bonding or adhesive/pressure bonding. Preferred is a thermal bonding process.

EXAMPLES

| | Scrubbing Layer | Absorbent Core Layer | Wiping Layer |
|---|---|---|---|
| Example 1 | MN-66-4.75 mesh[1]<br>MN-66-4.75 mesh[1] | TBAL[3]-one ply | apertured laminate web[4] |
| Example 2 | RO6277 mesh[2]<br>MN-66-4.75 mesh[1] | paper towel[5]-12 plies | apertured laminate web[4] |
| Example 3 | RO6200 mesh[2]<br>800287-102 mesh[2] | TBAL[3]-two plies | apertured laminate web[4] |
| Example 4 | RO6200 mesh[2]<br>WO3927 mesh[2] | TBAL[3] & polyester batting[6] | Spunlace[7] |

[1]100% polyethylene mesh from Masternet Ltd. Mississauga, Ontario, Canada
[2]100% polypropylene mesh from Conwed Plastics, Minneapolis, MN
[3]Thermal bonded air-laid nonwoven material from Buckeye Technologies, Memphis, TN containing 70% NSK, 30% PE/PP bicomponent fiber; 250 gsm
[4]20 gsm carded polypropylene, 24 gsm paper towel, 20 gsm carded polypropylene made according to U.S. patent application 09/467,938 and 09/584,676
[5]through-air dried, paper towel; 24 gsm; 70% softwood, 30% hardwood
[6]air-laid, carded, through air bonded 70% polyethylene/polyester bicomponent, 30% polyester from Polymer Group, Inc.
[7]Spunlace grade 140–146 from BBA Nonwovens, Simpsonville, SC The scrub pads of the examples are made by the following procedure.

1. A Vertrod Impulse Heat Sealer model 24LABMOD is set up such that both bottom and top elements are heated and rounded over. The heater is set for: Dwell time of 10 seconds, Heat time at 10.5V, 18 Amp. of 6 seconds, and an air pressure of 60 psi.
2. Take a 4 inch by 6 inch piece of each material to be used in the pad.
3. Arrange the materials in the desired configuration with the core material between the wiping layer and the scrubbing layer and such that the edges of the layers line up.
4. Pull on the materials so each layer lays flat with no puckering or bunching of material.
5. Place one edge of the arranged material into a Vertrod Impulse Heat Sealer model 24LABMOD and close sealer elements to initiate bonding.
6. When bonding cycle is complete, open sealer jaws, rotate material 90° to place the second edge in the sealer and bond edge. Repeat for third and fourth edges.
7. When bonding is complete, use s scissors to cut along bonded material to cut out the individual scrub pad leaving 2–4 mm. of bonded edge on the pad.

What is claimed is:

1. A scrub pad comprising:

a) a scrubbing layer having a periphery along the edges of the layer;

b) a wiping layer having a periphery along the edges of the layer, wherein the wiping layer is selected from the group consisting of cellulosic fibrous web material, laminated thermoplastic/cellulosic webs; and hydroentangled, spunbond, carded, and apertured nonwoven materials, wherein the wiping layer further comprises an apertured laminate web comprising a) a first outer layer comprises a nonwoven web comprising a sufficient quantity of thermoplastic material;

b) a second outer layer comprises a nonwoven web comprising a sufficient quantity of thermoplastic material; and c) a third central absorbent layer;

disposed in a layered face-to-face relationship with the central absorbent layer disposed between the outer layers; and c) an absorbent core layer having a periphery along the edges of the layer comprising at least one absorbent material selected from the group consisting of short-fiber, air-laid nonwoven material, nonwoven plastic batting, cellulosic fibrous web materials, wax coated paper, corrugated paper, fluff pulp, cotton balls, cotton batting, and mixtures thereof;

wherein the absorbent core layer is located intermediate to the scrubbing layer and the wiping layer and wherein the scrubbing layer, the absorbent core layer and the wiping layer are joined at the periphery of each layer to form a bonded edge.

2. A scrub pad according to claim 1 wherein the first outer layer of the apertured laminate web comprises an apertured thermoplastic film, the second outer layer comprises an apertured thermoplastic film and the third central absorbent layer comprises paper.

* * * * *